US007125201B1

(12) United States Patent
Walters

(10) Patent No.: US 7,125,201 B1
(45) Date of Patent: Oct. 24, 2006

(54) SCUBA DIVER WEIGHT CARRYING BACKPACK

(76) Inventor: William D. Walters, 2230 Biscay Ct., Byron, CA (US) 94514

( * ) Notice: Subject to any disclaimer, the term of this patent is extended or adjusted under 35 U.S.C. 154(b) by 0 days.

(21) Appl. No.: 11/256,816

(22) Filed: Oct. 24, 2005

(51) Int. Cl.
*B63C 11/30* (2006.01)

(52) U.S. Cl. ..... 405/186; 405/185

(58) Field of Classification Search ..... 405/185, 405/186
See application file for complete search history.

(56) References Cited

U.S. PATENT DOCUMENTS 3,967,459 A * 7/1976 Denis ..... 405/186
4,455,718 A * 6/1984 Finnern ..... 405/186
4,752,263 A * 6/1988 Pritchard et al. ..... 405/186
4,887,932 A * 12/1989 Toth ..... 405/186
5,074,714 A * 12/1991 Franco ..... 405/186
5,199,820 A * 4/1993 Nicklo ..... 405/186

* cited by examiner

*Primary Examiner*—Frederick L. Lagman
(74) *Attorney, Agent, or Firm*—Bruce & McCoy; Ernest H. McCoy

(57) ABSTRACT

A scuba diver weight carrying backpack having a packboard for carrying a multiple of rectangular based weights thereon with a cover over the weights and longitudinal parallel rods engaged with the cover from top to bottom and projecting through aligned rows of the weights, the weights being held on the rods by a quick release draw pins engaged with the cover.

8 Claims, 4 Drawing Sheets

SCUBA DIVER WEIGHT CARRYING BACKPACK

BACKGROUND OF THE INVENTION

1. Field of the Invention

The present invention relates to a scuba diver weight carrying apparatus to counterbalance underwater buoyancy. More particularly, it relates to a backpack which encloses predetermined variable amounts of weights to compensate for the flotation factor of a specific diver, and the weights are spread therein in a relatively thin layer whereby air tanks can be mounted on the same backpack. Still more particularly, the present invention relates to a rigid metal weight carrying packboard for deep diving scuba divers from which either all or a predetermined variable number of the weights can be released by the diver in an emergency, and, alternatively, all of the weights can be extracted from the backpack en masse even while it is mounted on the diver.

Specifically, the present invention relates to a rigid metal backpack and air tank board for scuba divers which carries variable numbers of identical individual weights in a body-conforming relatively thin layer whereby air tanks can be mounted on the backpack adjacent to the weights and close to the diver's body. The weights are secured to the board with a quick release mechanism to permit the diver to dump all or a predetermined variable number of the weights while underwater in an emergency, and all of the weights may be extracted from the backpack as a unit as the diver emerges from the water. The design of the backpack board makes it possible for deckhands or helpers to assist a diver as he emerges from the water by lifting the weights from his backpack when he is standing on a boat swim step or dive platform.

2. Description of the Prior Art

The use of dive weights in one form or another for the purpose of offsetting scuba diver buoyancy and thereby facilitating underwater diver mobility is known in the prior art. However, despite the numerous designs, structures, and forms of apparatus disclosed by and utilized in the prior art, which have been developed for the accomplishment of the specific objectives, needs, and requirements of scuba divers, the devices, machines, apparatus, and methods which have been heretofore devised and utilized to accomplish these goals consist basically of familiar, expected, and obvious configurations, combinations, and arrangements of well known apparatus. This will become apparent from the following consideration of the closest known and relevant prior art.

Early scuba diver apparatus included recognition that compensation had to be provided to counterbalance buoyancy of the diver. Initially weights were strung on a belt which was secured around the diver's waist. These weight belt combinations increased in sophistication as the weights evolved in form and the belts transformed into quick release assemblies for emergency situations. The weights transitioned from lead blocks to body conforming configurations and further to bags of metal shot strung on a belt or secreted in pockets in a vest. Each of the evolutions preferably included a quick release mechanism to permit a diver to dump the weights in an emergency and ascend without the drag and negative buoyancy caused by the weights. This form of weight dump is very dangerous under the advanced diving extremes now routinely undertaken by present day experienced deep divers. The release of a weight belt causes an immediate uncontrolled ascent to the surface. This cannot be allowed to happen to a diver at depth who needs to undergo decompression during his ascent to avoid the bends. Therefore, release of a weight belt accidentally or in an emergency under these conditions can be life threatening and must be avoided. However, there are emergencies at depth that do require dumping weight to allow the diver to ascend but at a controlled rate. The present invention provides a solution to this problem.

A significant number scuba divers often have to carry their gear a distance to the water's edge or between multiple departure points, such as a vehicle or a storage area, to a destination, such as a boat or another vehicle. In these circumstances, the weights are a substantial portion of the load that the diver has to transport. The prior art has predominantly put the weight on the diver's waist which makes it hard to carry as the weight does not usually assume or provide a configuration which easily rides the diver's waist without bending over. If a weight belt is carried over the diver's shoulder while transporting it, the weight is unevenly distributed on the diver's body, which can cause severe muscle strain. Other forms of carrying the weights on a diver's back do not provide a quick release mechanism for an underwater weight dump.

Not until the present invention has the problem of weight carrying by scuba divers been significantly altered. The present invention moves the weight from the diver's waist to his back where loads are more easily carried while on land. More importantly, the present invention provides a selectable quick release for an emergency dump of a variable portion up to all of the weights in an emergency situation underwater. The backpack is made of metal and is rigid for mounting the air tanks thereto, and it can take enormous abuse. The design of the weight backpack of the present invention also makes it easier for a helper to lift the weights separately and assist the diver in donning the weights or removing them from the diver when he emerges from the water. The weights can be pulled from the backpack as a unit. Further, the diver can selectively drop a portion of the weights in an emergency and still control his ascent rate by having dropped less than all of the weights.

The scuba diver weight backpack contemplated according to the present invention departs substantially from the conventional concepts and designs taught and used by the prior art, and in doing so, provides an apparatus primarily developed for the purpose of overcoming the problems as described above, but it accomplishes the result in a different and improved manner for facilitating dive weight carrying more easily and conveniently in an ergonomically balanced load with a selectable portion quick release capability for operational safety.

SUMMARY OF THE INVENTION

In view of the foregoing known, obvious, and described disadvantages inherent in the known types of scuba diver anti-buoyancy weights presently existing in the prior art, the present invention provides a new method, apparatus, and construction for a scuba diver weight backpack wherein the same can be utilized to ergonomically carry the weight load on land and to provide a quick release of the weights in the water.

The general purpose construction of the present invention, which will be described hereafter in greater detail, has been designed to provide a new and improved scuba diver weight carrying apparatus which has all of the advantages of the prior art of scuba diver anti-buoyancy weights mentioned and described above. It is comprised of many novel features and advantages and performs the functions that result in a new scuba diver weight carrying backpack which is not anticipated, rendered obvious, suggested, or even implied by any of the prior art of scuba diver anti-buoyancy weights, and heretofore known, either alone or in any combination thereof.

The present invention is a scuba diver weight carrying backpack. It is comprised of a packboard having an upper end thereof formed for shoulder strap attachment thereto and the lower end thereof formed for waist belt/shoulder strap attachment thereto. The packboard provides a weight mount surface for positioning variable numbers of weights to reside thereon when gravity acts to hold the weights on the packboard. A top cover is detachably securable to the packboard and encloses in spaced relation weights mounted on the packboard. The cover is open at the upper and lower ends thereof to allow weights mounted on the packboard to be extracted from the upper end thereof and to slide downward and off the lower end thereof under the force of gravity when the packboard is oriented vertically. An upper end cover plate is detachably securable to the top cover at the upper end thereof, and a multiple of parallel rods extend through the upper end cover plate and are secured thereto. The rods are formed for mounting weights thereon which can slide therealong if unrestrained. The rods are provided with means for selectively engaging the weights. A quick release mechanism comprising a pair of releasable locking pins projects laterally through the top cover. A first release pin engages the upper end cover plate and holds the plate and rods in position on the packboard. A second release pin disposed at the lower end of the top cover holds weights mounted on the rods inside the cover on the packboard and engages the lowest row of weights under the cover disposed at the lower end of the packboard whereby, when the second pin is retracted from engagement with the top cover, at least a predetermined portion of the weights is released from restraint on the packboard and can slide thereoff when it is oriented vertically, lower end down, thereby unweighting the diver wearing the packboard.

The more important features of the invention have been broadly outlined in the preceding summary of the invention in order that the detailed description thereof which follows may be better understood and in order that the present contribution to an improvement in the art may be better appreciated. There are additional features of the invention that will be described hereinafter and which will form the subject matter of the claims appended hereto.

With respect to the claims hereof, and before describing at least one preferred embodiment of the invention in detail, it is to be understood that the invention is not to be limited in its application to the details of construction and to the arrangements of the components which are set forth in the following description or illustrated in the accompanying drawings. The invention is capable of being created in other embodiments and of being practiced and carried out in various ways. Also, it is to be understood that the phraseology and terminology employed here are for the purpose of description and should not be regarded as limiting.

As such, those skilled in the art in which the invention is based will appreciate that the conception upon which this disclosure is predicated may readily be utilized as a basis for the designing of other forms, structures, apparatus, systems, and methods for carrying out the several purposes of the present invention. It is important, therefore, that the claims be regarded as including such equivalent constructions in so far as they do not depart from the spirit and scope of the present invention.

Further, the purpose of the appended abstract is to enable the United States Patent and Trademark Office, and the public generally, and especially scientists, engineers and practitioners of the art who are not familiar with the patent and legal terms or phraseology, to determine quickly from cursory inspection the nature and essence of the technical disclosure of the application. The abstract is neither intended to define the invention of the specification, which is measured by the claims, nor is it intended to be limiting as to the scope of the invention in any way.

OBJECTS OF THE INVENTION

It is therefore an important object of the present invention to provide a new and novel scuba diver anti-buoyancy weight carrying system that fits on a diver's back and to which air dive tanks may be secured.

It is another object of the present invention to provide a backpack for scuba divers for carrying anti-buoyancy weights ergonomically while out of the water and from which the weights may be extracted as a unit from above as the diver emerges from the water.

It is a further object of the present invention to provide a scuba diver anti-buoyancy weight carrying system which has a quick release for the weights to selectively dump a portion thereof to permit a controlled ascent to the surface or all of them in an emergency.

It is yet another object of the present invention to provide a weight carrying backpack from in which the number of weights to be released, less than all of them, can be predetermined before a dive.

And it is yet another object of the present invention to provide an anti-buoyancy weight carrying backpack for a deep diving scuba diver which carries weights in a metal enclosure for strength and to absorb abuse while preventing distortion and which supports a multiple of air tanks attached to it as an integrated a backpack unit.

Other objects and advantages of the present invention will become apparent when the method and apparatus of the present invention are considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
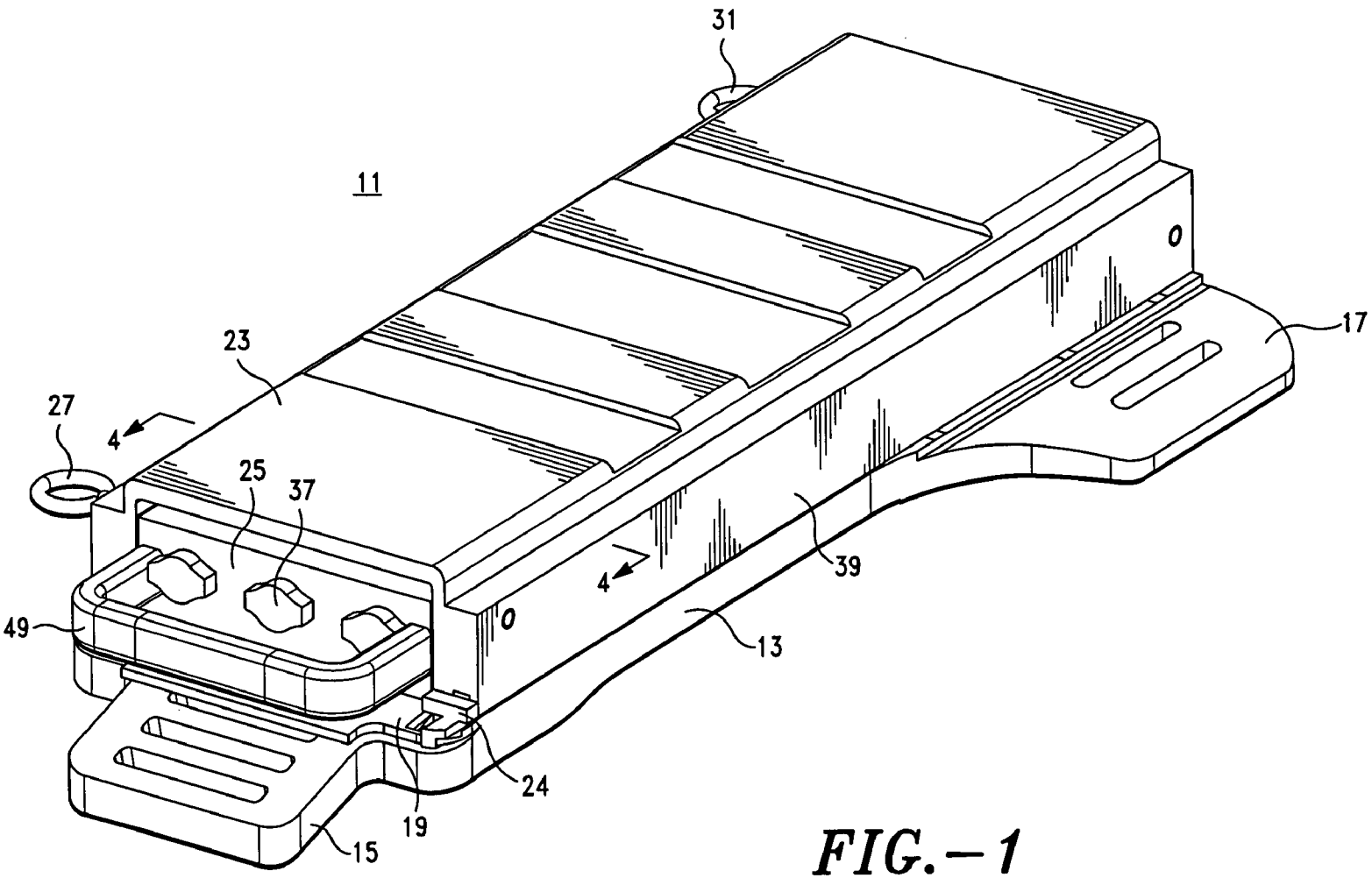
FIG. 1 is a perspective view of the upper end of a scuba diver weight carrying backpack of the present invention.
Figure 2:
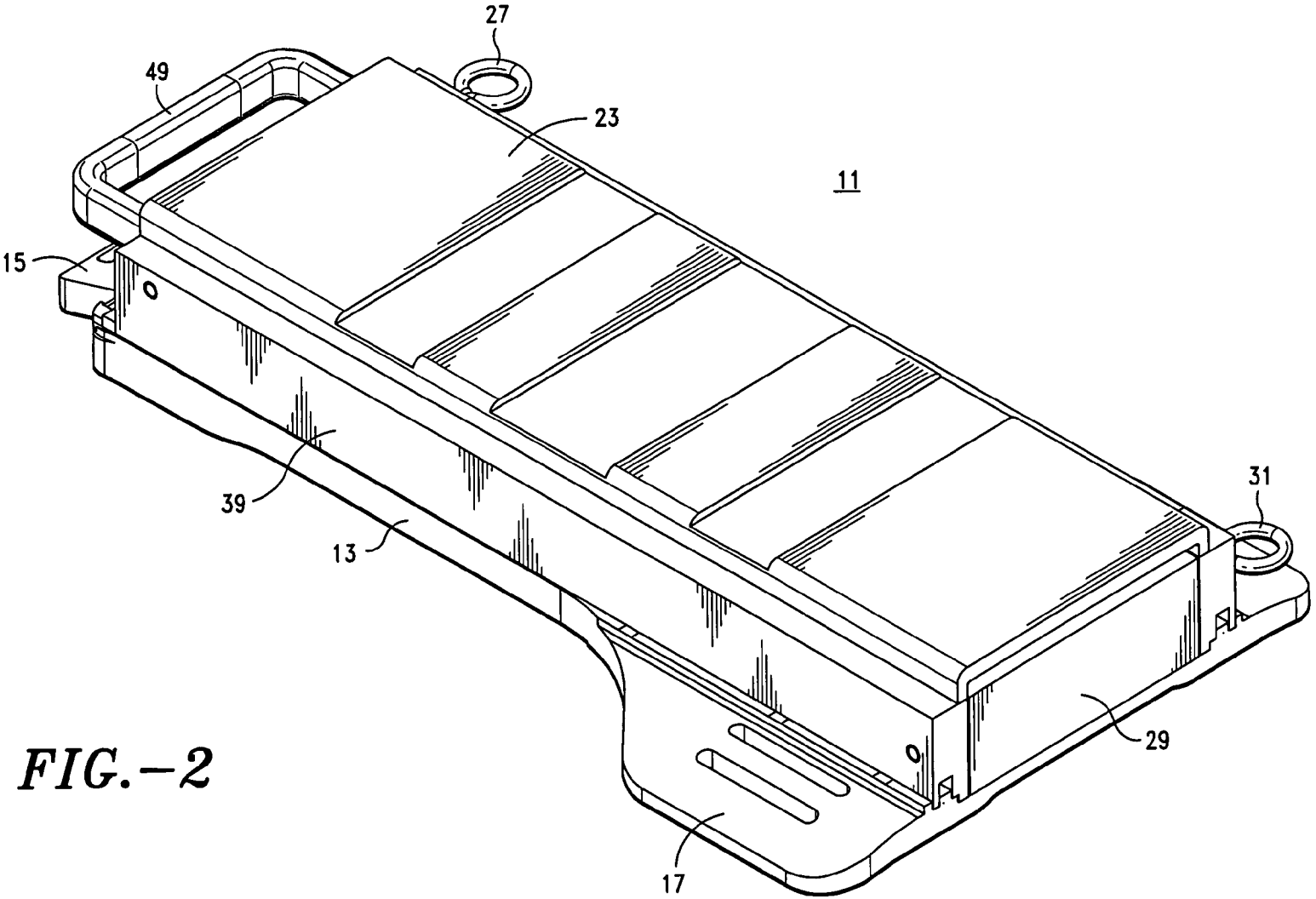
FIG. 2 is a perspective view of the lower end thereof.
Figure 3:
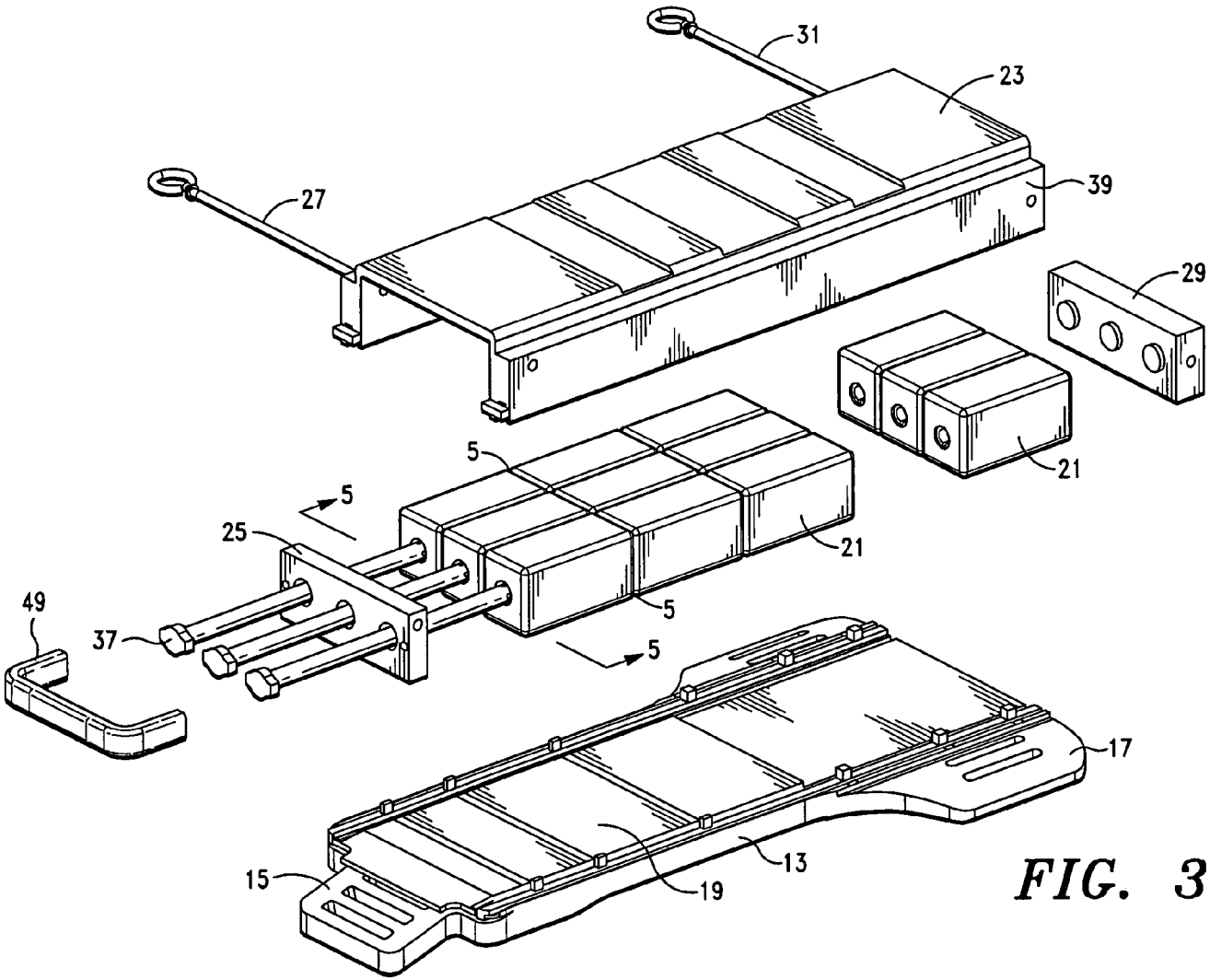
FIG. 3 is an exploded perspective view thereof.

FIGS. 1–3 show the preferred embodiment of the present invention which is a scuba diver weight carrying backpack 11 and air tank mounting board designed predominantly for deep divers. It is made of stainless steel for strength and to resist corrosion. It is comprised of an internal packboard 13 having an upper end thereof 15, formed for shoulder strap attachment thereto, and a lower end thereof 17 formed for attachment thereto of either a waist belt, or shoulder strap, or a combination thereof. The packboard provides an enclosed weight mount surface 19 for positioning variable numbers of individual weights 21 thereon and securing them thereto with a quick release mechanism.

The number of weights placed on the packboard can be varied to accommodate the varying anti-buoyancy indexes of various sizes and weights of divers. Plastic or other lightweight composition material spacers of the same configuration as the weights can be included in to the weight selection to provide a proper mix for a specific anti-buoyancy for a particular diver. In addition to permitting the selection of the specific number of weights to compensate for the diver's buoyancy, they can be distributed on the board for balance by virtue of the plastic spacers. This accommodation permits positioning the weights to the diver's individual preference for proper weight and balance.

In the preferred embodiment of the invention, the packboard 13 has a generally flat body conforming configuration for the diver's body contact portion thereof. For this purpose, the packboard is narrower at the upper end 15, to fit between the diver's shoulder blades, and wider at the lower end 17 to permit it to ride on the hips of the diver when the lower end of the packboard is secured thereto by a waist belt. The shoulder straps and waist belt may be individually secured to the lower end of the backpack or may be interconnected for securement thereto.

The external or outward facing portion of the packboard 13 is a generally flat weight mounting surface 19 formed to permit the individual weights 21 to slide thereon when the upper end 15 of the packboard is elevated and the weights are unrestrained. The weights normally reside on the packboard when gravity acts to hold the weights thereon but the surface is formed for guiding the weights off the board under the force of gravity when the upper end thereof is elevated to proximate the vertical which means to the elevated angulation where the friction between the weights and the packboard is overcome by the force of gravity.

A top cover 23 is detachably secured to the lateral edges of the packboard 13. In a preferred embodiment of the invention, the packboard is provided with edge slots to receive the free and support edges of the cover side walls 39. The top ends of the cover side walls can be provided with studs 24 which engage underneath form receptacles 26 secured to the packboard. The lower ends of the top cover side walls can be secured to the packboard with stainless steel screws, bolts, or other hold down devices.

The top cover encloses, in close spaced relation, a multiplicity of weights 21 or spacers mounted on the packboard. The cover is open at the upper and lower ends 15, 17 between the side walls thereof to allow weights mounted on the packboard to slide in either direction off the packboard when unrestrained. The weights slide downward and off the lower end thereof when the packboard is oriented vertically upward, and the weights can be extracted from the upper end thereof irrespective of orientation when they are not locked onto the packboard. The internal walls of the cover form edge guides which, when a weight release mechanism is activated by the diver wearing the backpack (when he is oriented vertically upright), guide the weights as they slide off the packboard.

Except during an ascent from depth, a diver is usually oriented fairly horizontal or slightly head downward during a dive. Under these latter conditions, the weights do not slide off the packboard even if a release mechanism (there are two in the present invention) is activated. In order for the weights to overcome friction on the packboard, one end thereof needs to be elevated approaching a vertical orientation. Since it would be dangerous and unlikely that a diver would release the weights when he is headed vertically downward, the term "vertical orientation" as used herein with relation to releasing the weights means such an upright orientation of the diver in the water that the weights will overcome friction and slide off the lower end of a packboard mounted on his back.

An upper end cover plate 25 is detachably secured to the top cover 23 by a first locking or release pin 27 which prevents the weights 21 from sliding out of the top of the packboard 13 when the diver is head down in the water. The first release pin 27 extends through the upper end cover plate longitudinally and through the opposite top ends of the side walls 39 of the top cover.

A lower end cover plate 29 is similarly positioned inside the lower end walls 39 of the top cover 23 below the lowest row of weights 21 under the top cover. It is secured by a second locking or release pin 31 which projects through the opposite bottom ends of the side walls 39 of the top cover 23 and through the lower end cover plate. The second or lower release pin prevents weights from sliding off the lower end 17 of the packboard when a diver is oriented upright.

The release pins 27, 29 can be provided with ring members (for attachment of pull cords) at their external projecting ends disposed external to the top cover side walls 39. The opposite ends can be provided with threads to engage the side walls whereby the release pins can be screwed in to engage the side walls and lock the pins to the top cover. The release pins can be arranged to unlock with three to six turns to disengage from the top cover but remain in position to restrain the weights and spacers 21 therein. O-rings can be provided in the side walls to surround the release pins to retain them in position in the unlocked condition. As will be explained, the upper or first release pin prevents a preselected or predetermined portion of the weights from dropping when the lower or second release pin is pulled thereby effecting a partial predetermined weight drop. The lower end cover plate can be eliminated when the second release pin restrains the lower weights directly.

The weights and spacers 21 carried by the packboard 13 are comprised of a multiple of similar equal-width configurations having at least one flat generally rectangular side for positioning on or toward the packboard. The weights and spacers are equal width so that they can be aligned in closely spaced rows along the length of the board. In the preferred embodiment of the invention, the weight and spacer units are also equal length so that they may be arranged in ordered horizontal and vertical rows as shown in FIG. 3. The flat sides of the units are positioned on the board to provide stability to the load so that the weights do not rattle or change orientation on the pack board until they are released.

Figure 6:
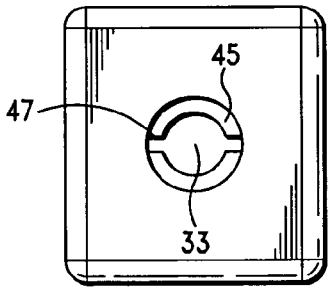
FIG. 6 is an end view of one of the weights as used with the backpack of the present invention.

The weight and spacer units each have aligned bores 33 or longitudinal openings disposed equidistant from the flat surfaces thereof and parallel thereto whereby the units can be mounted on a series of parallel control rods 35. In other words, a control rod can be inserted through a multiple of aligned weights and spacers mounted on the packboard. In the preferred embodiment of the present invention, the weights are identical configuration rectangular lead bricks as shown in FIGS. 3 and 6. The plastic spacers have identical effective configurations to the weights.

A multiple of parallel control rods 35 extend through the upper end cover plate 25 and through the sets of aligned weights and spacers 21 mounted on the packboard 13 which can slide along the rods if unrestrained. The rods are engaged with the packboard upper end cover plate by extending therethrough and are provided with means for selectively engaging the weights and spacers.

The short ends of the control rods 35 which extend to the outside of the upper end cover plate 25 are capped by index knobs 37 or caps which prevents the ends of the rods from being pulled out of the upper end cover plate and indicate the rotational orientation of the rods with respect to the cover plate.

The index knobs 37 can be set to safe (lock), in which case the weights 21 are locked onto the rods 35, or release (unlock) for diving. With the weights locked onto the rods, they can be lifted as a unit by a handle 49 attached to the upper end cover plate 25. In the release setting, a predetermined number or portion of the weights at the lower ends of the rods are free to slide thereon toward the lower end 17 of the packboard 13 but they are restrained by the lower end cover plate 29.

The control rods 35 are provided with cross-pins 41 which can selectively engage the weights 21 and by rotation of the rods disengaged therefrom. The cross-pins in a simple form are force-fitted spring metal tubes slotted lengthwise so that they can be radially compressed slightly and inserted and removed from the cross-holes in the rods but will expend sufficiently to remain in place when so positioned. The rods are provided with pairs of perpendicular cross-holes 43 disposed at equally spaced positions therealong so that the cross-pins can be positioned at perpendicular alternate orientations. The cross-pins are positioned along the rods so that they can reside in recesses 45 formed by counterbores in the weight bricks as shown in FIG. 6. As a result of the regular spacing of the cross-pins, the bricks can be arranged in ordered rows both vertically and horizontally as shown in FIG. 3.

Figure 4:
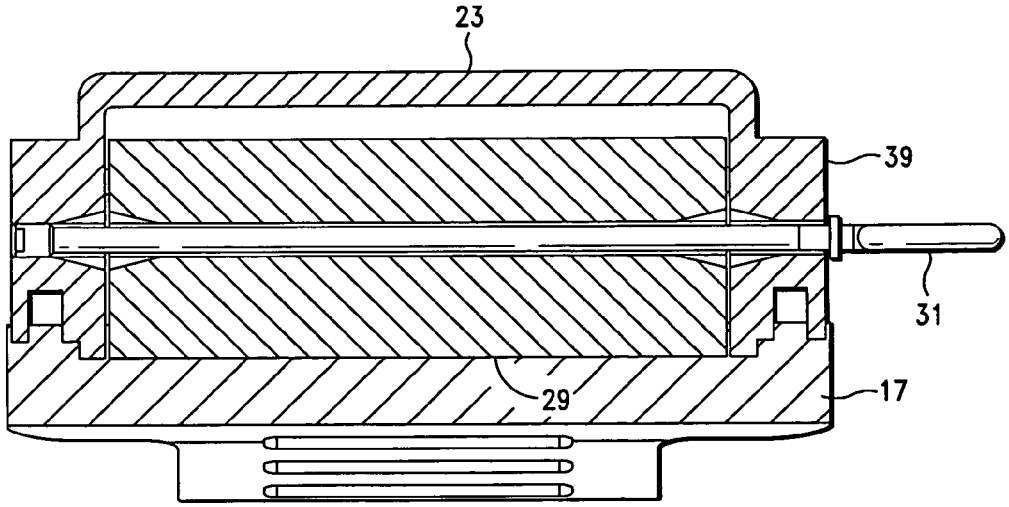
FIG. 4 is a cross-section view of the lower end of the backpack taken along lines 4—4 of FIG. 1.
Figure 5:
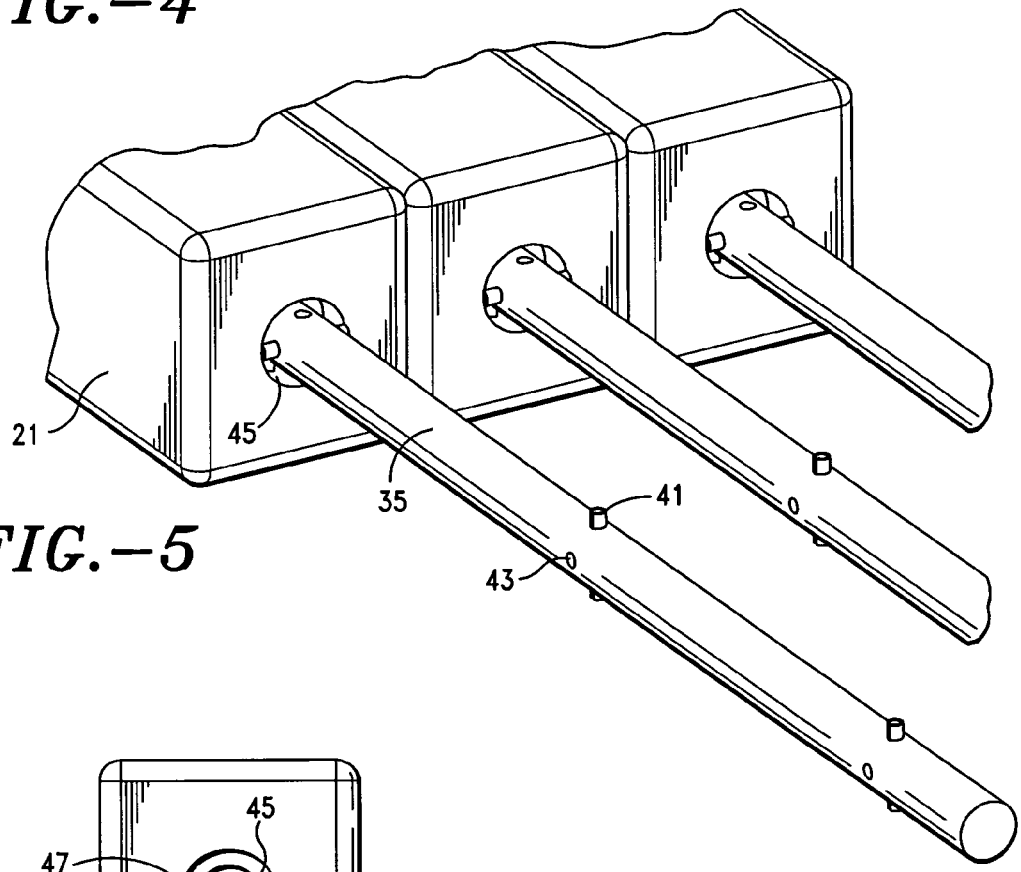
FIG. 5 is a close-up broken out view taken along line 5—5 of FIG. 3.

Reference is made to FIGS. 4, 5, and 6 which show those portions of the backpack 11 quick release mechanism for the weights and spacers 21 which has multiple interactive components and permits selective release of a portion thereof. The mechanism is comprised primarily of the first (top) and second (bottom) locking release pins 27, 31 projecting horizontally (from side to side) through the top and bottom covers 25, 29 which interact with the selective settings of the cross-pins 41 on the rods 35 which engage the weights and spacers. The cross-section view of FIG. 4 shows the second release pin and its engagement with the lower end cover plate and the top cover side walls 39.

FIG. 5 shows the control rods 35 which extend from the upper end cover 25 and project through the bores 33 of the aligned weight and spacer bricks 21. FIG. 6 shows an end view of one of the weight bricks or spacers and the proximate end of a bore 33 therethrough. The bores are slotted lengthwise with opposing slots 47 on opposite sides of the bores and extending for the lengths thereof. The ends of the longitudinal bores are counterbored to form recesses 45 for receiving the cross-pins 41 in the rods.

When the diver is about to enter the water, the index knobs 37 are set to release from lock. A portion of the cross-pins 41 disposed at the lower end of the control rods 35 align with the slots 47 in certain of the weight brick or spacer bores 33, and those weights were spacers can slide on the rods. When the index knobs are set to safe, all of the cross-pins are rotated out of alignment with the slots in the bores, and the weights and spacers are restrained and cannot slide on the rods.

The potential alignment or non-alignment of the cross-pins 41 with the slots 47 in the bores 33 of the weights and spacers 21 is set by the diver before a dive by inserting the cross pins 41 into one or the other of the cross holes in the control rods 35. The indexing knobs 37 on the ends of the rods 35 disposed on the external side of the upper end cover plate 25 indicate the orientation of the cross-pins with respect to the bores. When the second release pin 31 is pulled, those weights and spacers 21 having their slots aligned with the cross-pins will slide on the rods assuming the rods are oriented vertically upright (and all of the lower weights also have their cross-pins aligned with their respective slots).

This arrangement of cross-pins 41 and slots 47 permits predetermined selection of what portion of weights and spacers 21 are dropped from the backpack 11 by pulling the second or lower release pin 31. The number of weights which are to be dropped are positioned at the lower end 29 of the packboard 13 and have their slots 47 aligned with the cross-pins 41 on the control rods 35 when the index knob 37 for the rod is turned to the dive (release) position. Those weights which are not to be dropped have had their cross-pins inserted perpendicular to the cross-pins of the weights below them on the packboard which are to be dropped, and the upper weights and spacers will not slide on the rod when the second release pin is pulled because the cross-pins are not aligned with the slots; they are 90 degrees out of alignment with the slots. When the index knobs on the rods are turned to safe, all of the cross-pins are turned 45 degrees out of alignment with the weight brick slots and none of the weight and spacer bricks will slide on the rods. In this condition, the first or upper release pin 25 can be pulled and all of the weights and spacers can be lifted as a unit out from the upper end of the top cover 23.

To change the number of weights and spacers 21 to be dropped by pulling the second or lower release pin 31, the weights or spacers are removed from the packboard 13 and the desired number of cross-pins 41 are repositioned crosswise appropriately to increase or decrease the number of weight bricks or spacers which will slide on the rods 35 when the index knobs 37 are set to release for a dive and the second release pin 31 is pulled.

The first release or upper locking pin 27 is offset to avoid interference with the control rods 35 which project through the upper end cover plate 25. When the first pin is pulled, the weights and spacers 21 can slide as a unit in either direction out from under the top cover 23 unless restrained against downward movement by the separate second release pin 31 at the lower other end 17 of the top cover. When the second pin is retracted from engagement with the top cover (such as when the pin is pulled in an emergency during a dive), at least a predetermined or selected portion of the weights are released from restraint on the packboard 13 and can slide thereoff and out from under the lower end of the top cover (if the force of gravity on the weights overcomes friction) thereby quickly unweighting the diver wearing the packboard. However, only a predetermined portion of the weights are released to permit a controlled ascent.

If the diver wants to release all of the weights 21, he first pulls the first or upper release pin 27, and all of the weights, spacers, and control rods fall away as a unit when the lower or second release pin 31 is subsequently pulled. Alternatively, if the second or lower release pin is pulled first, only a predetermined number of weights, which number was selected before the dive, fall free and away from the diver. The remainder of the weights can be dumped by then pulling the first release pin. In other words, the diver can in effect sequentially release the weights in two groups or drop all of the weights simultaneously, depending upon the order in which the release pins are pulled.

The lower end cover plate 29 restrains the weights and spacers 21 from departing the lower end 17 of the packboard 13. If the index knobs 37 are set to release, and the backpack 11 is oriented vertically, the preselected portion of the weights will be released downward on the rods 35 toward the lower end of the packboard to rest on the lower cover plate 29 (or the second release pin 31 if there is no lower cover plate) to await release by extraction of the second release pin.

After a normal dive has been completed, during which the weights were not dumped, and as the diver emerges from the water, the knobs 37 are set to safe by a helper and the first release pin 27 is pulled. The weights can then be extracted from the diver's backpack as a unit by the helper.

Thus, it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

I claim:

1. A scuba diver weight carrying backpack comprising a packboard having an upper end thereof formed for shoulder strap attachment thereto and a lower end thereof formed for waist belt/shoulder strap attachment thereto, said packboard providing a weight mount surface for positioning variable numbers of weights to reside thereon when gravity acts to hold the weights on said board, a top cover detachably securable to said packboard and enclosing in spaced relation weights mounted on said packboard, said cover being open at the upper and lower ends thereof to allow weights mounted on said packboard to be extracted from said upper end thereof and to slide downward and off said lower end thereof under the force of gravity when said packboard is oriented vertically, an upper end cover plate detachably securable to said top cover at said upper end thereof, a multiple of parallel control rods extending through said upper end cover plate and engaged therewith, said rods formed for mounting weights thereon which can slide therealong if unrestrained, said rods being provided with means for selectively engaging said weights, a quick release mechanism for said weights comprising a pair of removable two or locking pins projecting laterally through said top cover, a first release pin engaging said upper end cover plate and holding said plate and said rods in position on said packboard, a second release pin disposed at the lower end of said top cover to hold weights mounted on said rods inside said cover on said packboard and restraining the lowest row of weights under said cover disposed at the lower end of said packboard whereby when said second pin is retracted from engagement with said top cover, at least a predetermined portion of said weights are released from restraint on said packboard depending upon which weights are not engaged with said rods and can slide thereoff when said packboard is oriented vertically lower end down thereby unweighting the diver wearing the packboard.

2. The scuba diver backpack of claim 1 including a multiple of similar configuration weights in the spacers each having at least one flat generally rectangular equal width and length sides for positioning on said packboard, said weights and spacers each having aligned bores therethrough disposed equidistant from said flat surfaces and parallel thereto whereby said weights and spacers can be mounted on said rods to reside with said rectangular sides facing said packboard in parallel equal width rows.

3. The scuba diver weight backpack of claim 2 wherein said weights and spacers are identical configuration rectangular bricks and can be arranged on said packboard mounted on said rods in ordered vertical and horizontal rows.

4. The scuba diver backpack of claim 2 wherein said control rods are provided with cross-pins which can selectively engage said weights and spacers and by rotation of said rods be disengaged therefrom.

5. The scuba diver weight carrying backpack of claim 4 wherein said quick release mechanism for said weights and spacers includes upper and lower end cover plates secured to said top cover by separate upper and lower release pins projecting through said end cover plates and through said top cover side walls at the upper and lower ends thereof whereby when said lower release pin is pulled, at least a portion of said weights and spacers mounted on said packboard and not engaged to said cross-pins can slide out from under said top cover and off said packboard when a diver wearing said backpack orients vertically upright in the water, and when said upper release pin is pulled and all of said weights are engaged with said cross-pins, said weights can be pulled out of the top of said backpack or, when said lower release pin is subsequently pulled, all of said weights can slide out the bottom of said backpack as a unit when said packboard is oriented vertically.

6. A scuba diver weight carrying backpack comprising a packboard having an upper end thereof formed for shoulder strap attachment thereto and a lower end thereof formed for waist belt/shoulder strap attachment thereto, said packboard providing a weight mount surface for positioning variable numbers of weights and spacers to reside thereon when gravity acts to hold the weights on said board, a top cover having side walls detachably securable to said packboard and enclosing in spaced relation weights and spacers mounted on said packboard, said cover being open at said upper and lower ends thereof to allow weights and spacers mounted on said packboard to be extracted from the upper end thereof and to slide downward and off said lower end thereof under the force of gravity when said packboard is oriented vertically, upper and lower end cover plates detachably securable to said top cover at said upper and lower ends thereof by first and second release pins, respectively, projecting through said cover plates and said top cover side walls, a multiple of parallel control rods extending through said upper end cover plate and engaged therewith, said rods formed for mounting weights and spacers thereon which can slide therealong if unrestrained, a multiple of identical configuration generally rectangular brick weights and spacers, each having aligned central bores therethrough whereby said weights and spacers can be arranged on said packboard mounted on said rods in ordered vertical and horizontal rows, a quick release mechanism for said weights and spacers comprised of said release pins projecting laterally through said top cover side walls and said end cover plates, said rods being provided with cross-pins which can selectively engage said weights and spacers and by rotation of said rods be disengaged therefrom, said first release pin engaging said upper end cover plate and holding said plate and said rods in position on said packboard, and said second release pin engaging said lower end cover plate to hold weights mounted on said rods inside said top cover on said packboard whereby when said lower release pin is pulled, said weights and spacers not engaged to said rods by said cross-pins can slide out from under said top cover and off said packboard when a diver wearing said backpack orients vertically upright in the water, and when said upper release pin is pulled, said weights and spacers engaged to said rods by said cross-pins can be pulled out of the top of said backpack as a unit or when said lower release pin is subsequently pulled and when said packboard is oriented vertically, all of said weights can slide out the bottom of said backpack as a unit.

7. The scuba diver weight carrying backpack of claim 6 wherein said cross-pins are spaced along the length of said rods and said aligned bores in said weight and spacer bricks have opposing slots extending for the length of said bores and said bricks having recesses disposed at at least one end of said bricks surrounding said bores within which cross-pins can be contained and in which said cross-pins can slide through said bores when aligned with said slots whereby, when said cross-pins are indexed to align with said slots, said bricks can slide on said rods, and when said cross-pins are indexed out of alignment with said slots, said bricks are prevented from sliding on said rods.

8. A scuba diver weight carrying backpack comprising a packboard having an upper end thereof formed for shoulder strap attachment thereto and a lower end thereof formed for waist belt/shoulder strap attachment thereto, said packboard providing a weight mount surface for positioning variable numbers of weights to reside thereon when gravity acts to hold the weights on said board, a top cover detachably securable to said packboard and enclosing in spaced relation weights mounted on said packboard, said cover being open at the upper and lower ends thereof to allow weights mounted on said packboard to be extracted from said upper end thereof and to slide downward and off said lower end thereof under the force of gravity when said packboard is oriented vertically, upper and lower end cover plates detachably securable to said top cover at said upper and lower ends thereof, a multiple of parallel control rods extending through said upper end cover plate and engaged there with, said rods formed for mounting weights and spacers thereon which can slide therealong if unrestrained, said rods being provided with cross-pins which can selectively engage said weights and by rotation of said rods be disengaged therefrom, said cross-pins being spaced along the length of said rods so that said weights and spacers can be individually engaged and mounted on said packboard in ordered vertical and horizontal rows, a multiple of identical configuration rectangular brick weights and spacers, each having aligned central bores therethrough, said bricks having opposing slots extending for the length of said bores and said bricks having recesses disposed at the lower ends thereof surrounding said bores wherein said cross-pins can be contained and in which said cross-pins can slide through said bores when aligned with said slots whereby, when said cross-pins are indexed to align with said slots, said bricks can slide on said rods, and when said cross-pins are indexed out of alignment with said slots, said bricks are prevented from sliding on said rods, a quick release mechanism for said weights and spacers comprising a pair of removable locking in release pins projecting laterally through said top cover side walls parallel to said packboard, a first upper locking pin engaging said upper end cover plate and holding said plate and said rods in position on said packboard, a second lower locking pin engaging said lower end cover plate to hold weights and spacers mounted on said rods inside said top cover on said packboard whereby when said lower release pin is pulled, at least a predetermined portion of said weights and spacers mounted on said backboard and not engaged with said cross-pins on said rods (and not having a weight or space or below it engaged with said rods) can slide out from under said top cover and off said packboard when a diver wearing said backpack orients vertically upright in the water, and when said upper release pin is pulled, those of said weights and spacers having a weight or space or below it engaged with said cross-pins can be pulled out of the top of said backpack or when said lower release pin is subsequently pulled, all of said weights and spacers can slide out the bottom of said backpack as a unit when said packboard is oriented vertically.

* * * * *